United States Patent [19]

Harris et al.

[11] 4,406,254

[45] Sep. 27, 1983

[54] METHOD FOR LEAN OPERATION OF SPARK-IGNITED GASOLINE-FUELED RECIPROCATING ENGINE

[75] Inventors: Stephen J. Harris, Troy; Bruce D. Peters, Rochester, both of Mich.

[73] Assignee: General Motors Corporation, Detroit, Mich.

[21] Appl. No.: 347,519

[22] Filed: Feb. 10, 1982

[51] Int. Cl.[3] ..... F02B 75/12; F02B 77/00

[52] U.S. Cl. ..... 123/1 A; 123/198 A; 44/56; 44/57

[58] Field of Search ..... 123/1 A, 3, 198 A; 44/56, 57

[56] References Cited

U.S. PATENT DOCUMENTS

| | | | |
|---|---|---|---|
| 2,093,008 | 9/1937 | Egerton | 44/57 |
| 2,403,771 | 7/1946 | Vaughan | 44/57 |
| 2,522,015 | 9/1950 | Barusch | 44/57 |
| 2,534,309 | 12/1950 | Sheffield | 44/57 |
| 2,537,853 | 1/1951 | Pezzaglia | 44/57 |
| 3,108,864 | 10/1963 | Barusch | 44/57 |
| 4,045,188 | 8/1977 | Hirschey | 44/56 |
| 4,298,351 | 11/1971 | Earle | 44/56 |

*Primary Examiner*—Charles J. Myhre
*Assistant Examiner*—E. Rollins Cross
*Attorney, Agent, or Firm*—George A. Grove

[57] ABSTRACT

In a preferred embodiment a spark-ignited gasoline-fueled reciprocating internal combustion engine is advantageously operated with a fuel-lean air-fuel mixture, when the gasoline fuel contains about 1% to 5% by volume of a dialkyl peroxide, such as ditertiary butyl peroxide.

5 Claims, No Drawings

METHOD FOR LEAN OPERATION OF SPARK-IGNITED GASOLINE-FUELED RECIPROCATING ENGINE

This invention relates to improved fuel lean combustion in a reciprocating gasoline-fueled engine. More specifically, this invention relates to gasoline-additive blends that support good burning in fuel lean mixtures with air in the combustion chamber of such an engine.

Combustion of suitable lean mixtures in spark ignition engines is believed to give rise to higher efficiency utilization of the fuel and to lower exhaust emissions as compared to combustion of rich mixtures. Fuel lean mixtures are mixtures of gasoline with air or other oxygen-containing fuel in which there is a chemical excess of oxygen. In other words, the ratio of the quantity of fuel to the quantity of oxygen in terms of chemical equivalents for complete combustion, herein called the equivalence ratio, is less than 1.0. If such a mixture is ignited and burned, the fuel may all be consumed with oxygen left over.

In a spark ignited engine the fuel is burned by propagation of a flame from the spark source through the combustion chamber, i.e., the cylinder of the engine. As the fuel-air mixture becomes leaner, the rate of flame propagation decreases. Of course, combustion should be substantially complete before the exhaust valve opens. In general experience, the combustion quality of homogeneous mixtures of fuel and air in spark ignited engines deteriorates to unacceptable levels because of slow and erratic burning for mixtures leaner than about 0.7 to 0.8 equivalence ratio of fuel to oxygen.

One method of circumventing the problem of poor combustion of lean fuel mixtures is to stratify the fuel-air mixture in a combustion chamber or prechamber of the engine. In this practice a stoichiometric mixture of fuel and air or a slightly fuel lean mixture is ignited and burning commenced. Later in the combustion process in the operation of the engine, the burning mixture is diluted with more air so that the overall mixture ratio may be considerably leaner. This practice, however, requires an engine modification that produces such a gradient in the proportions of air and fuel.

It is an object of this invention to provide a method for lean fuel operation of a gasoline engine using chemically altered gasoline. By using a modified gasoline fuel in accordance with our invention, an engine can be suitably operated with a substantially leaner fuel-air mixture than can otherwise be employed.

In accordance with a preferred embodiment of our invention, this and other objects are accomplished by first preparing a fuel blend consisting essentially of gasoline and a suitable dialkyl peroxide. Ditertiary butyl peroxide is the perferred additive. It is a clear liquid that is soluble in gasoline and its boiling point (111° C.) is at about the midpoint of the boiling range of most gasolines. Preferably, it is mixed with gasoline in an amount in the range of about 1% to 5% by volume of the gasoline.

We have found that gasoline-ditertiary butyl peroxide blends can be mixed with excess air, for example, at a fuel to air equivalence ratio of less than 0.7, and used in a spark ignition reciprocating engine. Although this mix is very fuel lean compared with the air to fuel mixtures normally used, nevertheless the mixture burns reliably and smoothly in the engine. An engine can be operated in this manner over prolonged periods of time with improved fuel efficiency and reduced nitrogen oxide exhaust emissions.

These and other objects and advantages of our invention will become more apparent from a detailed description thereof which follows.

In order to evaluate the effect of ditertiary butyl peroxide on the lean operating limit of a spark ignition engine, tests were conducted with a Cooperative Fuel Research engine (a one-cylinder engine) operating at 1,200 revolutions per minute, a compression ratio of 7, a nonshrouded inlet valve and at a constant air flow rate of 3.86 grams per second.

Clear Indolene gasoline was used. Indolene is produced by Amoco to have very closely matching properties from batch to batch so that it can be reliably used in comparative tests. Mixtures of clear Indolene with one volume percent ditertiary butyl peroxide (chemical purity of 98.5%), with 5 volume percent ditertiary butyl peroxide and with 5 volume percent ethanol were respectively used for comparison.

The engine was equipped with inlet port fuel injection. The fuel was injected into the inlet port over about a 40° crank angle interval while the inlet valve was closed. An American Bosch type APE mechanical fuel injection pump and an American Bosch model AKB 50563B single hole injector (opening pressure equals 8.96 MPa) were used. The nonshrouded inlet valve in the engine produced negligible swirl and minimized fuel-air mixture stratification when inlet port fuel injection was used. A high energy ignition system was used with a spark duration of 2.5 ms and an energy of 40 mJ. The spark plug was a Champion type D-16 with a 0.85 mm gap. The engine was operated at an inlet air temperature of 64° C., coolant temperature of 74° C., and oil temperature of 70° C.

The fuel-air equivalence ratios were computed using the oxygen-based method of Stivender, "Development of a Fuel-Based Mass Emission Measurement Procedure", SAE Paper No. 710604. Measured exhaust concentrations of CO, $CO_2$, $O_2$, HC and NO were used in the calculations. Nondispersive infrared analyzers were used for CO and $CO_2$, a paramagnetic analyzer was used for $O_2$, a flame ionization detector monitored HC, and a chemiluminescence analyzer was used for NO and $NO_x$.

We used the lean misfire limit (LML) as our criterion for the effect of the fuel on lean combustion behavior. The LML is the equivalence ratio of the leanest mixture that will ignite with MBT (minimum advance for best torque) spark timing. LML is defined as the condition where between one and ten misfires occur in 500 engine cycles. A misfire is a cycle in which a pressure rise due to combustion does not occur. We concluded that the use of the LML is justified as a test of lean combustion behavior because the onset of irregular combustion, as mixtures become leaner, is first manifested in the ignition and early flame development process. Thus, a fuel-air mixture with improved lean combustion behavior should have a leaner LML.

Experimentally, the LML's were established by using the following procedure. First, the spark timing was set to the MBT level for a given fuel mixture just on the rich side of the LML. Second, with the spark timing fixed, the mixture was made leaner until the misfire criterion was met. Experiments were repeated at least once for each condition, except for the ethanol-clear Indolene blend. All tests were conducted using the above-specified constant air flow rate. The spark timing was set at 55 crank angle degrees before top dead center. This was the MBT spark setting for all fuels tested at an equivalence ratio of about 0.72. The equivalence and air-fuel ratios and exhaust emissions at the LML's were determined for clear Indolene, 1 and 5 volume percent ditertiary butyl peroxide in clear Indolene and 5 volume percent ethanol in clear Indolene. The results are presented in the following table:

| Fuel | Stoichiometry and Emissions at the Lean Misfire Limit* Equivalence Ratio | Air-Fuel Ratio | $NO_x$ ppm | CO % | HC ppm $C_3$ |
|---|---|---|---|---|---|
| Clear Indolene | 0.70 ± 0.01 | 20.8 ± 0.1 | 170 ± 40 | 0.13 ± 0.01 | 1800 ± 100 |
| Clear Indolene plus 1 vol. percent dtBP | 0.66 ± 0.02 | 22.1 ± 0.5 | 70 ± 30 | 0.20 ± 0.06 | 2000 ± 200 |
| Clear Indolene plus 5 vol. percent dtBP | 0.63 ± 0.01 | 22.8 ± 0. | 40 ± 10 | 0.21 ± 0.01 | 2200 ± 100 |
| Clear Indolene** plus 5 vol. percent ethanol | 0.69 | 20.6 | 235 | 0.15 | 1600 |

*Uncertainties are one standard deviation.
**Only one test was conducted with the ethanol blend.

It is seen that compared to clear Indolene the addition of one volume percent peroxide extended the LML by 6% while addition of 5 volume percent peroxide extended it by 10%. It is our belief that the beneficial effects of the ditertiary butyl peroxide result from the presence of the easily broken O-O peroxide bond. We believe that such molecular bonds produce free radicals in the combustible mixture that increase the rate of the combustion reactions and, therefore, the rate of heat release and thereby help extend the lean flammability limit.

Since chemical bonds in alcohols are stronger than the O-O bond in ditertiary butyl peroxide, the addition of small amounts of alcohols was not expected to increase the number of free radicals and the rate of combustion relative to clear Indolene. As shown in the above table, the alcohol-Indolene blend decreased the LML by only 0.01 as compared to clear Indolene. Exhaust gas concentrations of $NO_x$, CO and HC at the LML's are also reported in the above table. $NO_x$ dropped 59% and 76% for the 1% and 5% peroxide mixtures, respectively. This decrease in $NO_x$ content of exhaust reflected the changes in equivalence ratio and associated lower combustion temperatures at the LML's. The higher HC and CO emissions with the peroxide-containing fuels are probably due to slower oxidation in the relatively cool exhaust system. It should also be noted that HC levels were high in all cases because of the occurrence of misfires at the LML.

It is our expectation that analogous lower dialkyl peroxides will produce related combustion enhancing effects in gasoline, permitting operation of reciprocating engines at very lean fuel-air mixtures. Such dialkyl peroxides must be soluble in gasoline in the amounts used, and stable for reasonable periods of storage. An example in diethyl peroxide. However, we prefer the use of ditertiary butyl peroxide because it is miscible with gasoline and particularly compatible with it in the proportions used. It is a clear liquid having a boiling point of 111° C., and a freezing point of −40° C. Fuel-ditertiary butyl peroxide mixtures were not unstable or corrosive, at least over relatively short periods. For example, the 5 volume percent mixture gave the same results after being stored for a week in a stainless steel can. It appeared to us that neither steel nor rubber components were attacked by the peroxide when they were placed in a beaker of the peroxide for several days.

The addition of ditertiary butyl peroxide increased the knocking tendency of the engine when operating at stoichiometric air-fuel conditions. However, with the leaner mixtures that we prefer, knock was not observed. However, it will be apparent that the use of ditertiary butyl peroxide in high compression ratio engines would require restricting the operating range to equivalence ratios outside the near stoichiometric ragion where the tendency to knock is greatest.

While our invention has been described in terms of a preferred embodiment thereof, it will be appreciated that other forms would be readily adapted by those skilled in the art, and accordingly the scope of our invention should be limited only by the following claims.

The embodiments of the invention in which an exclusive property or privilege is claimed are defined as follows:

1. A method of operating a spark-ignited, gasoline-fueled, reciprocating internal combustion engine, said method comprising mixing air or other suitable oxygen-containing gas with a fuel consisting essentially of gasoline mixed with at least about 1% by volume of a dialkyl peroxide such that there is an excess of oxygen with respect to the fuel for purposes of combustion, and spark igniting the mixture in the combustion chambers of the engine to propel the power strokes thereof, said peroxide containing fuel burning reliably in the lean fuel-oxygen combustion mixture over prolonged engine operation to provide relatively high efficiency usage of the gasoline and relatively low $NO_x$ emissions.

2. A method of operating a spark-ignited, gasoline-fueled, reciprocating internal combustion engine, said method comprising mixing air or other suitable oxygen-containing gas with a fuel consisting essentially of gasoline mixed with at least about 1% by volume of a dialkyl peroxide such that the proportion of said fuel to oxygen is less than about 0.7 of the chemical equivalence ratio of fuel to oxygen, and spark igniting the mixture in the combustion chambers of the engine to propel the power strokes thereof, said peroxide containing fuel burning reliably in the lean fuel-oxygen combustion mixture over prolonged engine operation to provide relatively high efficiency usage of the gasoline and relatively low $NO_x$ emissions.

3. A method of operating a spark-ignited, gasoline-fueled, reciprocating internal combustion engine, said method comprising mixing air or other suitable oxygen-containing gas with a fuel consisting essentially of gasoline mixed with at least about 1% by volume of ditertiary butyl peroxide such that there is an excess of oxygen with respect to the fuel for purposes of combustion, and spark igniting the mixture in the combustion chambers of the engine to propel the power strokes thereof, said peroxide containing fuel burning reliably in the lean fuel-oxygen combustion mixture over prolonged engine operation to provide relatively high efficiency usage of the gasoline and relatively low $NO_x$ emissions.

4. A method of operating a spark-ignited, gasoline-fueled, reciprocating internal combustion engine, said method comprising mixing air or other suitable oxygen-containing gas with a fuel consisting essentially of gasoline mixed with at least about 1% by volume of ditertiary butyl peroxide such that the proportion of said fuel to oxygen is less than about 0.7 of the chemical equivalence ratio of fuel to oxygen, and spark igniting the mixture in the combustion chambers of the engine to propel the power strokes thereof, said peroxide containing fuel burning reliably in the lean fuel-oxygen combustion mixture over prolonged engine operation to provide relatively high efficiency usage of the gasoline and relatively low $NO_x$ emissions.

5. A method of operating a spark-ignited, gasoline-fueled, reciprocating internal combustion engine, said method comprising mixing air or other suitable oxygen-containing gas with a fuel consisting essentially of gasoline mixed with about 1% to about 5% by volume of ditertiary butyl peroxide such that the proportion of said fuel to oxygen is less than about 0.7 of the chemical equivalence ratio of fuel to oxygen, and spark igniting the mixture in the combustion chambers of the engine to propel the power strokes thereof, said peroxide containing fuel burning reliably in the lean fuel-oxygen combustion mixture over prolonged engine operation to provide relatively high efficiency usage of the gasoline and relatively low $NO_x$ emissions.

* * * * *

UNITED STATES PATENT AND TRADEMARK OFFICE

CERTIFICATE OF CORRECTION

PATENT NO. : 4,406,254

DATED : September 27, 1983

INVENTOR(S) : Stephen J. Harris, Bruce D. Peters

It is certified that error appears in the above-identified patent and that said Letters Patent are hereby corrected as shown below:

Column 3, in the chart, the third amount under "Air-Fuel Ratio", "22.8 ± 0." should read -- 22.8 ± 0.3 --.

Column 3, line 59, after "example" change "in" to -- is --.

Column 4, line 28, "ragion" should read -- region --.

Signed and Sealed this

*Twentieth* Day of *December 1983*

[SEAL]

*Attest:*

GERALD J. MOSSINGHOFF

*Attesting Officer*

*Commissioner of Patents and Trademarks*